United States Patent [19]

Mazzorana

[11] Patent Number: 4,684,816

[45] Date of Patent: Aug. 4, 1987

[54] STARTER WITH TWO MOTORS

[76] Inventor: Alfred B. Mazzorana, 12 Rue Fernand Léger, FR - 69200 Venissieux, France

[21] Appl. No.: 800,196

[22] Filed: Nov. 21, 1985

[30] Foreign Application Priority Data

Dec. 6, 1984 [FR] France ..... 84 18848
Dec. 7, 1984 [FR] France ..... 84 18954

[51] Int. Cl.[4] ..... F02N 11/02
[52] U.S. Cl. ..... 290/38 R; 290/48
[58] Field of Search ..... 290/37, 38 R, 48; 123/179 R

[56] References Cited

U.S. PATENT DOCUMENTS 1,561,820 11/1925 Bedford ..... 290/48 X
2,302,680 11/1942 Dyer ..... 290/37
2,769,437 11/1956 Taylor ..... 123/179
2,930,901 3/1960 Freeman ..... 290/38 R
2,989,873 6/1961 Clark ..... 290/38 R X

*Primary Examiner*—Bernard Roskoski
*Assistant Examiner*—W. E. Duncanson, Jr.
*Attorney, Agent, or Firm*—Dowell & Dowell

[57] ABSTRACT

A driving pinion fixed on the shaft of a first motor meshes with a toothed wheel mounted to rotate freely with respect to the casing of the starter and which includes a bore having helical grooves with which cooperate corresponding grooves made on the periphery of the shank of an actuator pinion which is engagable with the crown wheel of a combustion engine. The spur toothing of the actuator pinion are in mesh with the inner toothing of a bore of another pinion which is actuated by a second motor. Resilient members are provided to normally urge the actuator pinion out of engagement with the crown wheel of the combustion engine.

12 Claims, 6 Drawing Figures

STARTER WITH TWO MOTORS

BACKGROUND OF THE INVENTION

1. Field of the Invention

The present invention relates to improvements in electric starters having two drive motors of which one serves in a first stage for the advance of an actuator via a fixed longitudinal nut driven in rotation by this first motor, while the actuator is driven in rotation in a second stage both by the first and second motor.

2. History of the Art

U.S. Pat. No. 2,302,680 discloses starters of the type similar to the present invention in which one of the motors serves for the advance of the actuator by rotation of a longitudinally fixed nut cooperating with an outer thread of a bushing mounted about the shaft of the armature of the main motor. The powers of the two motors are added in order to transmit an increased effort to the pinion of the actuator. Such a starter is complex as the auxiliary motor actuates the nut via a toothed bevel gear which is expensive to produce and delicate to assemble. Such a starter cannot allow the use of a reducer associated with the shaft of the armature of the main motor, with the result that the main motor must be of a large size.

SUMMARY OF THE INVENTION

The process according to the invention consists in having first drive source act on reduction gears with a view to provoking the advance of the actuator member of the starter and its meshing with respect to that of the crown wheel of the combustion engine. Thereafter, a second drive source is provided for rotating the actuator member then upon detecting the moment of start of the thermal motor, cutting off the first drive source so that the second drive source through the reduction gears returns the actuator member to its rest position.

According to a first embodiment in accordance with the invention, a driving pinion fixed on the shaft of a first motor meshes with a toothed wheel mounted to rotate freely with respect to the casing of the starter and which includes a bore having helicoidal grooves with which cooperate corresponding grooves made on the periphery of the shank of the actuator pinion which meshes with the crown wheel of the combustion engine. The spur toothing of the pinion being in mesh with the inner toothing of complementary shape of the bore of a pinion which meshes with a driving pinion fixed on the shaft of a second motor, while axial return means are associated with the actuator pinion.

The pinion which meshes with the driving pinion of the second motor preferably comprises an elongated hub having a bore which is provided with a spur toothing cooperating with that of the actuator pinion.

According to a second embodiment of the invention, the first motor actuates a reducer of which the driven wheel comprises a hub with helicoidally grooved bore which cooperates with the periphery of complementary shape of the tubular shank of the actuator. The shaft along which the actuator slides includes a bearing surface with straight ribs which engage in axial grooves made in the bore of the tubular shank mentioned above, while the shaft of the actuator is fixed with the driven wheel of a reducer actuated by the second motor.

BRIEF DESCRIPTION OF THE DRAWINGS

The invention will be more readily understood on reading the following description with reference to the accompanying drawings, in which.

Figure 1:
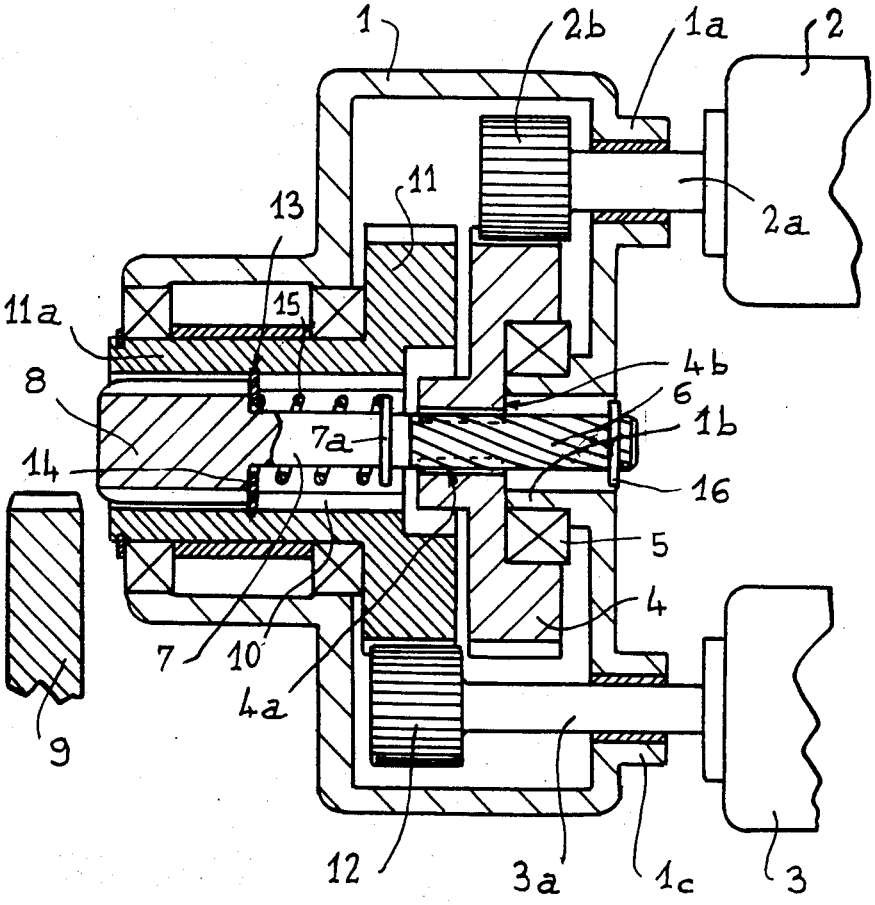
FIG. 1 is a longitudinal section of an electric starter according to a first embodiment of the invention.

The starter illustrated in FIG. 1 essentially comprises a casing 1 containing mechanisms which will be described hereinafter and which are controlled by a first electric motor 2 and by a second electric motor 3. Motor 2 comprises a driven shaft 2*a* rotating in a bearing 1*a* in the casing 1 and on which is fixed a pinion 2*b* which meshes with a toothed wheel 4 mounted to rotate freely about a bearing 5, for example ball bearing, with respect to a hollow boss 1*b* of the casing 1. The wheel 4 includes a bore provided with helicoidal grooves 4*a* in which are engaged lands and grooves 6 made on the end part of the shank 7 of a pinion 8. The pinion 8 includes toothing which is adapted to come into mesh with the toothing of the crown wheel 9 of a combustion engine. It is observed that the toothing of the pinion 8 cooperates with longitudinal grooves 10 made in the bore of a pinion 11. More exactly, the pinion comprises an elongated hollow hub 11*a* having a bore in which the grooves 10 are made.

Pinion 11 meshes with a pinion 12 fixed on the shaft 3*a* of the second motor 3, and the shaft rotates in a bearing 1*c* of casing 1.

In the bore of the pinion 11, there is also made a groove 13 in which is engaged a split ring 14 which constitutes a rest stop for pinion 8. In fact, between the ring 14 and a flange 7*a* of the shank 7 there is disposed a compression spring 15 which maintains, at rest, the rear of the pinion 8 in abutment on ring 14.

It is noted that the free end of the shank 7 of pinion 8 is provided with a peripheral stop 16.

Operation follows from the foregoing explanations:

When the motor 2 is switched on, pinion 2*b* rotates, driving wheel 4 in rotation. Due to friction, the pinion 11 is immobilized rotationally. Cooperation between the helicoidal grooves 4*a* and 6 respectively of wheel 4 and of shank 7 of the pinion 8 causes the displacement of the pinion 8 towards the left against the reaction of spring 15, as long as and so that the toothing of the pinion 8 meshes with that of the crown wheel 9. This displacement towards the left is limited by the abutment of stop 16 against an annular bearing surface 4*b* of the wheel 4, the stop passing through the bore of boss 1*b*.

When pinion 8 meshes with the crown wheel 9, motor 3 is switched on so as to initiate rotation of wheel 11, which, due to the presence of its longitudinal grooves 10, rotates pinion 8 until the thermal engine has started. It is noted that the torque applied on the pinion 8 is the resultant of those developed by the two motors.

Figure 2:
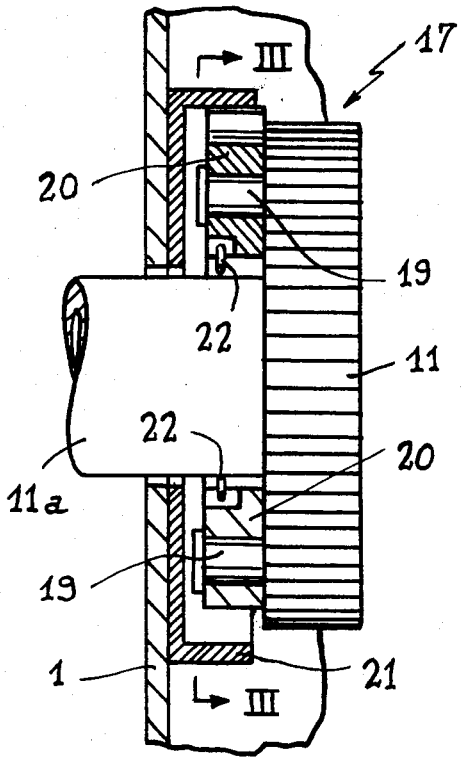
FIG. 2 illustrates a device for braking the pinion actuated by the second motor.
Figure 3:
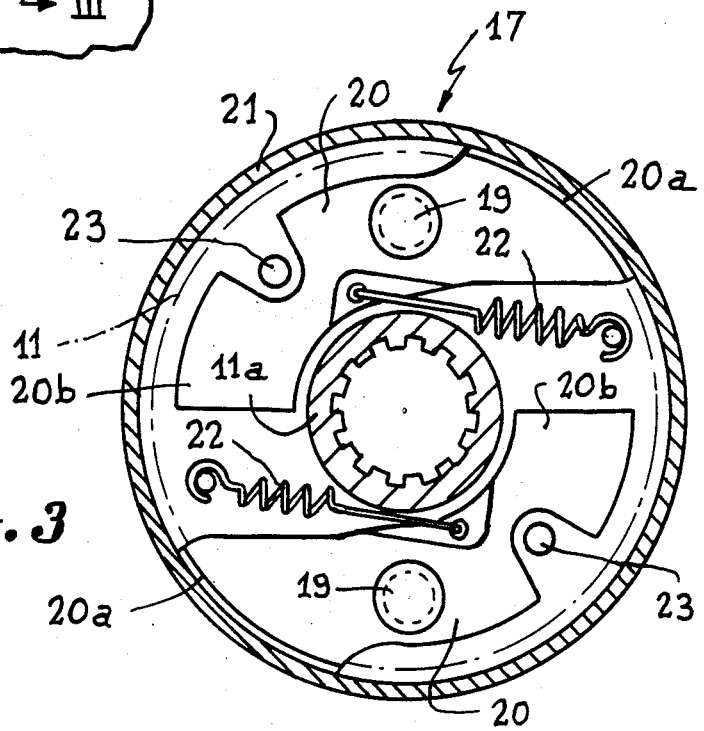
FIG. 3 is a section along III—III (FIG. 2).

In order to be certain of the advance of pinion 8, it is absolutely necessary that pinion 11 be angularly fixed. To this end, motor 3 may be with permanent magnets so that, by short-circuiting its brushes, the action of the simple frictions may be accentuated. A device such as the one 17 illustrated in FIGS. 2 and 3 may also be used. This device matches pinion 11 of which one of the faces includes two diametrically opposite pins 19 about which shoes 20 pivot. Each of the shoes comprises a pad 20*a* which comes into mesh with a rim 21 secured to with casing 1 because of the action of the two draw springs 22. At rest, the springs apply the pads against rim 21 in order to immobilize pinion 11.

As soon as wheel 11 is driven in rotation by motor 3, the shoes pivot about their axes since they present a greater mass opposite pads 20*a* with respect to their pivot axes 19. In this way, the pads leave rim 21 and pinion 11 is no longer braked. Studs 23 limit the outward pivoting of the shoes 20.

When the combustion engine has started, the electric supply to motor 2 is cut, with the result that the action of motor 3 on pinion 8 via pinion 11 brings about rescrewing of the groove part 6 of shank 7 with respect to the helicoidal grooves 4*a* of the pinion 4 which is angularly fixed. Spring 15 may also suffice for this return if the electric supply of motors 2 and 3 is simultaneously cut off, this simplifying the electrical control of the system.

It goes without saying that shank 7 and pinion 8 may be disconnected by interposing between these two elements a tooth-against-tooth spring, a free wheel system so as to reconstitute a conventional actuator.

Figure 4:
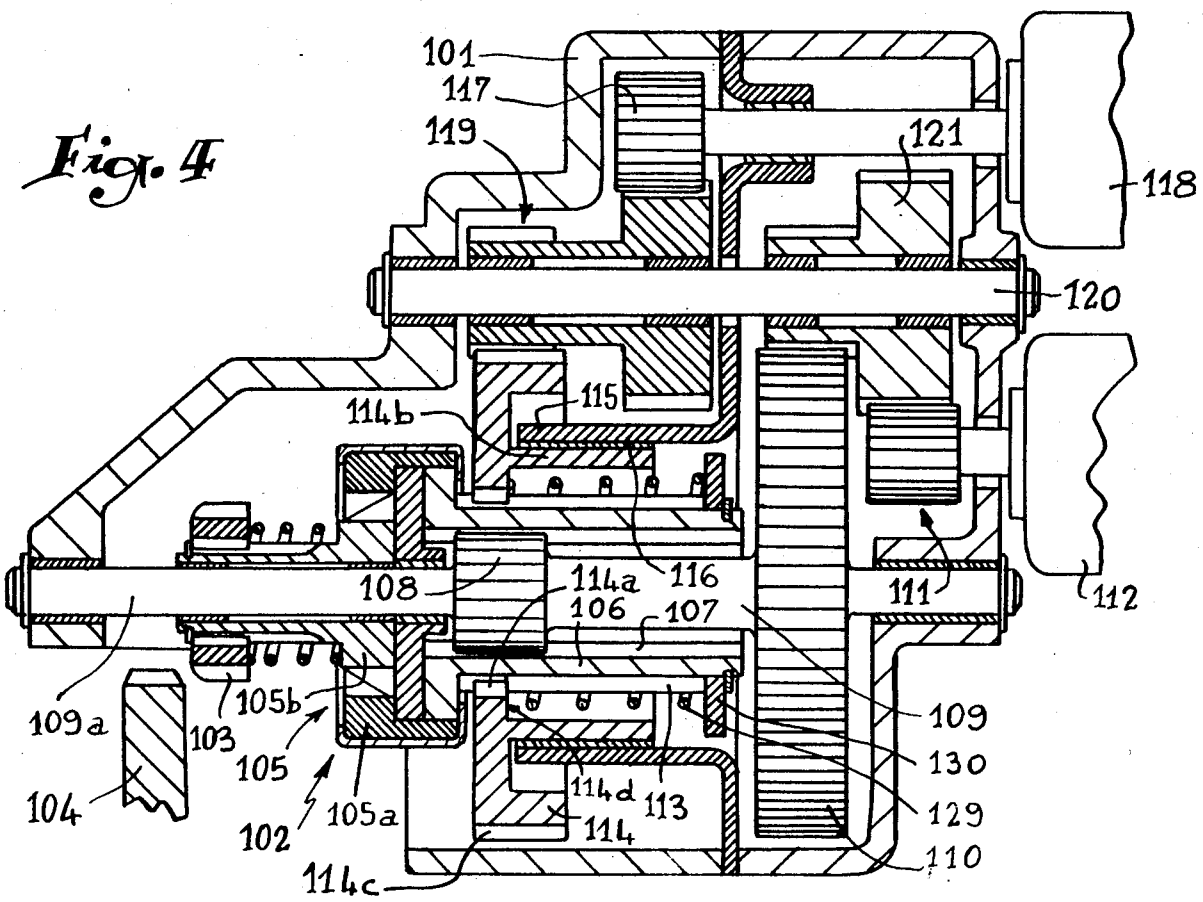
FIG. 4 is a section of an electric starter according to a second embodiment of the invention.

FIG. 4 illustrates an electric starter for a combustion engine comprising a casing 101 containing the various mechanisms for actuating the actuator 102 of the starter in question, this actuator being provided in the conventional manner with a pinion 103 adapted to come into mesh with a crown wheel 104 associated with the combustion engine. The actuator 102 conventionally comprises a free wheel 105 with outer cage 105*a* engaging a tubular shank 106 of which the inner bore comprises straight grooves 107. The tubular shank may therefore slide with respect to a bearing surface 108 provided with grooves complementary of those 107 and which forms part of a shaft 109 fixed to the driven wheel 110 of a reducer gear assembly 111. The reducer 111 is driven by the second motor 112 of the reducer according to the invention. The shaft 109 comprises a part 109*a* with reduced diameter along which slides the extension of the inner track 105*b* of the free wheel 105, this extension constituting support for the slide of the actuator 102.

The periphery of the bushing 108 is provided with helicoidal grooves 113 which are in mesh with complementary ribs 114*a* made in the bore of a toothed wheel 114. The wheel 114 includes a tubular sleeve 114*b* of larger diameter the periphery of which cooperates with a bearing 115 secured to the casing 101 via a bushing 116.

The pheripheral toothing 114*c* of wheel 114 is in mesh with the driven pinion 117 of the first motor 118 via a double pinion 119. It is observed that the double pinion 119 is mounted freely on a shaft 120 about which rotates a second double pinion 121 forming part of the reducer 111.

Operation is as follows:

Motor 118 is firstly switched on, this provoking rotation of wheel 114. As bushing 106 is immobilized from rotation, cooperation of the helicoidal grooves 113 with the complementary ones 114*a* of wheel 114 provokes longitudinal displacement of the actuator 102 towards the left, with the result that its pinion 103 comes, in conventional manner, into mesh with the crown wheel 104 of the thermal engine. At that moment, motor 112 is switched on in order to rotate shaft 109 which, via the straight grooves of its bearing surface 108, causes rotation of the bushings 106 and consequently that of pinion 103 which controls the crown wheel 104 to start the combustion engine. It is noted that the torque developed by the two motors are then applied on pinion 103.

When the combustion engine has started, current to the electric motor 118 is cut off with the result that the rotation of motor 112 which continues causes the return into initial position of actuator 105.

Figure 5:
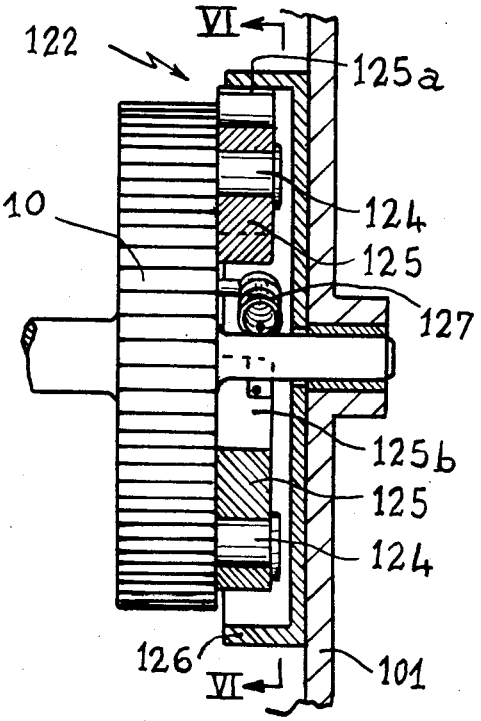
FIG. 5 illustrates a device for braking the driven wheel of the reducer actuated by the second motor.
Figure 6:
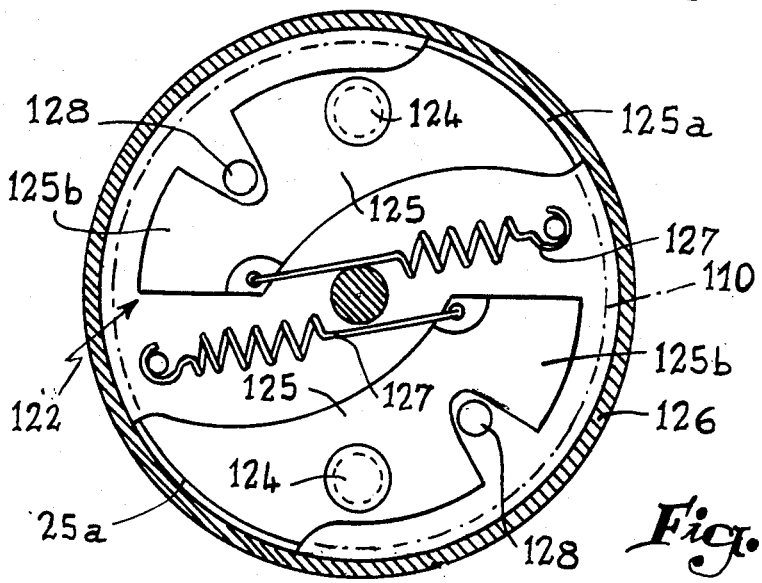
FIG. 6 is a section taken along VI—VI (FIG. 5).

It is obvious that the advance of the actuator can only be effected if shaft 109 is fixed from rotation. As indicated hereinabove, the various frictions between components may restrict the rotation of the shaft, but an immobilization device 122 illustrated in FIGS. 5 and 6 may be associated with wheel 110.

Device 122 matches pinion 110 meshing with the wheel 121 of reducer 111. One of the sides of pinion 110 bears two diametrically opposite pins 124 about which are pivotally mounted two shoes 125 adapted to cooperate with a fixed rim 126, for example engaging the casing 101 because of the presence of two draw springs 127. The shoes 125 are dissymmetrical, i.e. the distance separating their active part or pad 125*a* which cooperates with rim 126, is shorter than that which separates the pin in question from the rear part 125*b* of the shoes. In this way, when wheel 110 rotates, driven by wheel 121, the centrifugal force causes the shoes to rock, with the result that their pads 125*a* leave rim 126. The outward stroke of the shoes is limited by studs 128 engaged in notches in these shoes. Thus, when wheel 114 rotates, it necessarily causes actuator 102 to advance since the bearing surface 108 of shaft 109 is immobilized from rotation by device 122.

Once the combustion engine has started in conventional manner, the free wheel 105 disconnects pinion 103 from shaft 109 and a compression spring 129 disposed between a bearing surface 114*d* of wheel 114 and a stop 130 secured to bushing 106 provokes return to its initial position of the actuator upon stoppage of motors 118 and 112. Stop 130 constitutes a limit of advance of the actuator as it comes into abutment on the free edge of sleeve 114*d* of wheel 114.

It must, moreover, be understood that the foregoing description has been given only by way of example and that it in no way limits the domain of the invention which would not be exceeded by replacing the details of execution described by any other equivalents.

I claim:

1. A starter apparatus for combustion engines having crown wheels comprising a first drive means, first gear means drivingly engaged by said first drive means, an actuator means rotatably engaged by said first gear means, means for moving said actuator means from a rest position axially outwardly with respect to said first gear means in response to said actuator means being rotated by said first gear means, said actuator means having means for drivingly engaging the crown wheel of the engine, a second drive means, second gear means drivingly engaged with said second drive means, said second gear means being drivingly connected to said actuator means when said actuator means is in engagement with the crown wheel of the engine and when second drive means is activated, said second gear means causing said actuator means to return to said rest position when said first drive means is deactivated and while said second drive means remains activated.

2. The starter apparatus of claim 1 including a housing, said first drive means having a first drive pinion means disposed within said housing, said first gear means including a toothed wheel means engagable with said first driving pinion means, bearing means for rotatably supporting said wheel means within said housing, said wheel means having a central bore therethrough, said means for moving said actuator means from said rest position including helical grooves within said bore, said actuator means having an elongated shank which extends through said bore of said wheel means to a free end, teeth means and complementary grooves formed in said elongated shank of said actuator means, said grooves meshing with said helical grooves within said bore of said wheel means, said second drive means including a second driving pinion means disposed within said housing, said second gear means including a driven pinion means which encircles said teeth means of said actuator means, said driven pinion having an opening therethrough defining a plurality of second teeth means which are meshed with said teeth means of said actuator means.

3. The starter apparatus of claim 2 including resilient return means encircling said actuator means, said return means normally urging said actuator means toward said rest position.

4. The starter apparatus of claim 3 in which said driven pinion means includes an elongated hub, said opening extending generally axially of said hub, said actuator means being axially slideable relative to said hub and bearing means rotatably supporting said hub relative to said housing.

5. The starter apparatus of claim 3 including stop means carried adjacent said free end of said actuator means, a bearing surface, said stop means being engagable with said bearing surface to limit the axial movement of said actuator means away from said rest position.

6. The starter apparatus of claim 3 including an inertia brake means engagable with said driven pinion means, said inertia brake means preventing the rotation of said driven pinion means when said second drive means is not activated.

7. The starter apparatus of claim 3 in which said first and second drive means include first and second motors respectively, said first and second motors being operable to develop first and second driving torques, said first and second driving torques being transmitted to the crown wheel of the engine when said first and second motors are actuated.

8. The starter apparatus of claim 1 including a housing, said first drive means including a first drive pinion disposed within said housing, said first gear means including a first double pinion having one end drivingly engaged with said first drive pinion and the other end thereof drivingly engaged with a first driven wheel means which encircles said actuator means, said first driven wheel means including a hub portion defining an opening therethrough, a plurality of ribs within said hub portion, said actuator means including a tubular bushing having an outer surface having a plurality of helical grooves therein which are meshed with said ribs in said hub portion of said first driven wheel means and having a plurality of axially oriented grooves along the interior surface thereof, said second drive means including a second drive pinion which is disposed within said housing, said second gear means including a second double pinion means having first and second ends and a second driven wheel means, said first end of said second double pinion means being drivingly connected to said second drive pinion and said second end thereof being drivingly connected to said second driven wheel means, said second driven wheel means being fixedly secured to an elongated shaft means, said actuator means being slideably supported on said elongated shaft means, said elongated shaft means having a bearing surface with linear ribs which mesh with said axially oriented grooves of said tubular bushing of said actuator means.

9. The starter apparatus of claim 8 in which said tubular bushing of said actuator means includes a stop member which extends radially outwardly therefrom, said first driven wheel means including a sleeve portion against which said stop member is abutted as said actuator means moves axially outwardly from said rest position and spring means disposed between said first driven wheel means and said stop member for normally urging said actuator means toward said rest position.

10. The starter apparatus of claim 8 including first bearing means supported by said housing for rotatably supporting said first driven wheel means within said housing.

11. The starter apparatus of claim 8 in which said second driven wheel means includes an inertia brake means, said inertia brake means preventing rotation of said second driven wheel when said second drive means is not actuated.

12. The starter apparatus of claim 8 in which said first and second drive means include first and second motors respectively, said first and second motors being operable to develop first and second driving torques, said first and second driving torques being transmitted to the crown wheel of the engine when said first and second motors are activated.

* * * * *